US009458778B2

(12) United States Patent
Rayl et al.

(10) Patent No.: US 9,458,778 B2
(45) Date of Patent: Oct. 4, 2016

(54) CYLINDER ACTIVATION AND DEACTIVATION CONTROL SYSTEMS AND METHODS

(71) Applicant: GM GLOBAL TECHNOLOGY OPERATIONS LLC, Detroit, MI (US)

(72) Inventors: Allen B. Rayl, Waterford, MI (US); Randall S. Beikmann, Brighton, MI (US); Sanjeev M. Naik, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 738 days.

(21) Appl. No.: 13/798,586

(22) Filed: Mar. 13, 2013

(65) Prior Publication Data

US 2014/0053804 A1 Feb. 27, 2014

Related U.S. Application Data

(60) Provisional application No. 61/693,057, filed on Aug. 24, 2012.

(51) Int. Cl.
*F02D 7/00* (2006.01)
*F02D 41/00* (2006.01)
(Continued)

(52) U.S. Cl.
CPC ..... *F02D 41/0087* (2013.01); *F02D 41/1401* (2013.01); *F01L 13/0005* (2013.01);
(Continued)

(58) Field of Classification Search
CPC ..... F02D 2041/1412; F02D 41/0087; F02D 17/02; F02D 41/0225; F02D 41/021; F02D 41/1401; F02D 2041/0012; F02D 241/141; F02D 241/1437; F01L 2013/001; F01L 13/0005
USPC ..... 701/103, 104, 123, 102, 111, 112; 123/90.15, 198 F, 481
See application file for complete search history.

(56) References Cited

U.S. PATENT DOCUMENTS 3,596,640 A * 8/1971 Bloomfield ..... F02D 17/04 123/463
4,129,034 A * 12/1978 Niles ..... G01F 9/001 701/123

(Continued)

FOREIGN PATENT DOCUMENTS

CN 1573916 A 2/2005
CN 1888407 A 1/2007

(Continued)

OTHER PUBLICATIONS

U.S. Appl. No. 14/548,501, filed Nov. 20, 2014, Beikmann et al.

(Continued)

*Primary Examiner* — Stephen K Cronin
*Assistant Examiner* — Brian Kirby

(57) ABSTRACT

A ranking module determines N ranking values for N predetermined cylinder activation/deactivation sequences of an engine, respectively. N is an integer greater than or equal to two. A cylinder control module, based on the N ranking values, selects one of the N predetermined cylinder activation/deactivation sequences as a desired cylinder activation/deactivation sequence for cylinders of the engine. The cylinder control module also: activates opening of intake and exhaust valves of first ones of the cylinders that are to be activated based on the desired cylinder activation/deactivation sequence; and deactivates opening of intake and exhaust valves of second ones of the cylinders that are to be deactivated based on the desired cylinder activation/deactivation sequence. A fuel control module provides fuel to the first ones of the cylinders and disables fueling to the second ones of the cylinders.

18 Claims, 5 Drawing Sheets

(51) Int. Cl.

| | |
|---|---|
| *F02D 41/14* | (2006.01) |
| *F01L 13/00* | (2006.01) |
| *F02D 17/02* | (2006.01) |
| *F02D 41/02* | (2006.01) |

(52) U.S. Cl.

CPC ..... *F01L2013/001* (2013.01); *F02D 17/02* (2013.01); *F02D 41/021* (2013.01); *F02D 41/0225* (2013.01); *F02D 2041/0012* (2013.01); *F02D 2041/141* (2013.01); *F02D 2041/1412* (2013.01); *F02D 2041/1437* (2013.01)

(56) References Cited

U.S. PATENT DOCUMENTS 4,172,434 A 10/1979 Coles
4,377,997 A 3/1983 Staerzl
4,434,767 A 3/1984 Kohama et al.
4,489,695 A 12/1984 Kohama et al.
4,509,488 A * 4/1985 Forster ..... F02D 41/0087 123/198 F
4,535,744 A 8/1985 Matsumura
4,770,148 A 9/1988 Hibino et al.
4,887,216 A 12/1989 Ohnari et al.
4,974,563 A 12/1990 Ikeda et al.
4,987,888 A * 1/1991 Funabashi ..... F02D 41/045 123/406.46
5,042,444 A 8/1991 Hayes et al.
5,094,213 A 3/1992 Dudek et al.
5,226,513 A 7/1993 Shibayama
5,278,760 A 1/1994 Ribbens et al.
5,357,932 A 10/1994 Clinton et al.
5,374,224 A 12/1994 Huffmaster et al.
5,377,631 A 1/1995 Schechter
5,423,208 A 6/1995 Dudek et al.
5,465,617 A 11/1995 Dudek et al.
5,540,633 A * 7/1996 Yamanaka ..... F02D 11/105 123/198 F
5,553,575 A 9/1996 Beck et al.
5,584,266 A 12/1996 Motose et al.
5,669,354 A 9/1997 Morris
5,692,471 A 12/1997 Zhang
5,720,257 A 2/1998 Motose et al.
5,813,383 A 9/1998 Cummings
5,884,605 A 3/1999 Nagaishi et al.
5,909,720 A 6/1999 Yamaoka et al.
5,931,140 A 8/1999 Maloney
5,934,263 A 8/1999 Russ et al.
5,941,927 A 8/1999 Pfitz
5,975,052 A * 11/1999 Moyer ..... F01B 17/02 123/198 F
5,983,867 A 11/1999 Stuber et al.
6,125,812 A * 10/2000 Garabedian ..... F02D 41/1443 123/198 F
6,158,411 A 12/2000 Morikawa
6,244,242 B1 6/2001 Grizzle et al.
6,247,449 B1 6/2001 Persson
6,272,427 B1 8/2001 Wild et al.
6,286,366 B1 9/2001 Chen et al.
6,295,500 B1 9/2001 Cullen et al.
6,332,446 B1 12/2001 Matsumoto et al.
6,334,425 B1 1/2002 Nagatani et al.
6,355,986 B1 3/2002 Kato et al.
6,360,724 B1 3/2002 Suhre et al.
6,363,316 B1 3/2002 Soliman et al.
6,371,075 B2 4/2002 Koch
6,385,521 B1 5/2002 Ito
6,408,625 B1 * 6/2002 Woon ..... F02D 17/02 123/198 F
6,520,140 B2 * 2/2003 Dreymuller ..... F02D 17/04 123/198 F
6,546,912 B2 4/2003 Tuken
6,619,258 B2 9/2003 McKay et al.
6,622,548 B1 9/2003 Hernandez
6,694,806 B2 * 2/2004 Kumagai ..... F02D 41/2422 73/114.52
6,754,577 B2 6/2004 Gross et al.
6,760,656 B2 7/2004 Matthews et al.
6,850,831 B2 2/2005 Buckland et al.
6,909,961 B2 6/2005 Wild et al.
6,978,204 B2 12/2005 Surnilla et al.
6,980,902 B2 12/2005 Nakazawa
6,981,492 B2 1/2006 Barba et al.
6,983,737 B2 1/2006 Gross et al.
7,003,390 B2 2/2006 Kaga
7,024,301 B1 4/2006 Kar et al.
7,028,661 B1 4/2006 Bonne et al.
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,121 B2 6/2006 Michelini et al.
7,066,136 B2 6/2006 Ogiso
7,069,718 B2 7/2006 Surnilla et al.
7,069,773 B2 7/2006 Stempnik et al.
7,086,386 B2 8/2006 Doering
7,100,720 B2 9/2006 Ishikawa
7,111,612 B2 9/2006 Michelini et al.
7,140,355 B2 11/2006 Michelini et al.
7,159,568 B1 1/2007 Lewis et al.
7,174,713 B2 2/2007 Nitzke et al.
7,174,879 B1 2/2007 Chol et al.
7,200,486 B2 4/2007 Tanaka et al.
7,203,588 B2 * 4/2007 Kaneko ..... F02D 13/06 123/481
7,231,907 B2 6/2007 Bolander et al.
7,278,391 B1 10/2007 Wong et al.
7,292,231 B2 11/2007 Kodama et al.
7,292,931 B2 11/2007 Davis et al.
7,319,929 B1 1/2008 Davis et al.
7,363,111 B2 4/2008 Vian et al.
7,367,318 B2 5/2008 Moriya et al.
7,415,345 B2 8/2008 Wild
7,440,838 B2 10/2008 Livshiz et al.
7,464,676 B2 12/2008 Wiggins et al.
7,472,014 B1 12/2008 Albertson et al.
7,497,074 B2 3/2009 Surnilla et al.
7,499,791 B2 3/2009 You et al.
7,503,312 B2 3/2009 Surnilla et al.
7,509,201 B2 3/2009 Bolander et al.
7,555,896 B2 * 7/2009 Lewis ..... F01L 9/04 123/198 F
7,577,511 B1 * 8/2009 Tripathi ..... F02D 41/0087 701/103
7,581,531 B2 9/2009 Schulz
7,614,384 B2 11/2009 Livshiz et al.
7,620,188 B2 11/2009 Inoue et al.
7,621,262 B2 11/2009 Zubeck
7,634,349 B2 12/2009 Senft et al.
7,685,976 B2 3/2010 Marriott
7,785,230 B2 8/2010 Gibson et al.
7,836,866 B2 11/2010 Luken et al.
7,849,835 B2 12/2010 Tripathi et al.
7,886,715 B2 2/2011 Tripathi et al.
7,930,087 B2 4/2011 Gibson et al.
7,946,263 B2 5/2011 O'Neill et al.
7,954,474 B2 6/2011 Tripathi et al.
8,050,841 B2 11/2011 Costin et al.
8,099,224 B2 1/2012 Tripathi et al.
8,108,132 B2 1/2012 Reinke
8,131,445 B2 3/2012 Tripathi et al.
8,131,447 B2 3/2012 Tripathi et al.
8,135,410 B2 3/2012 Forte
8,145,410 B2 3/2012 Berger et al.
8,146,565 B2 4/2012 Leone et al.
8,272,367 B2 9/2012 Shikama et al.
8,347,856 B2 * 1/2013 Leone ..... F02D 41/0087 123/319
8,473,179 B2 6/2013 Whitney et al.
8,616,181 B2 12/2013 Sahandiesfanjani et al.
8,646,430 B2 2/2014 Kinoshita
8,646,435 B2 2/2014 Dibble et al.
8,701,628 B2 4/2014 Tripathi et al.

(56) References Cited

U.S. PATENT DOCUMENTS 8,706,383 B2 4/2014 Sauve et al.
8,833,058 B2 9/2014 Ervin et al.
8,833,345 B2 9/2014 Pochner et al.
8,869,773 B2 10/2014 Tripathi et al.
8,979,708 B2 3/2015 Burtch
9,140,622 B2 9/2015 Beikmann
9,222,427 B2 12/2015 Matthews et al.
2001/0007964 A1* 7/2001 Poljansek ..... F16H 61/0213 701/51
2002/0039950 A1 4/2002 Graf et al.
2002/0156568 A1* 10/2002 Knott ..... G01M 15/102 701/114
2002/0162540 A1 11/2002 Matthews et al.
2002/0189574 A1* 12/2002 Kim ..... F01L 13/0005 123/198 F
2003/0116130 A1 6/2003 Kisaka et al.
2003/0123467 A1 7/2003 Du et al.
2003/0131820 A1* 7/2003 Mckay ..... F01L 13/0005 123/198 F
2003/0172900 A1 9/2003 Boyer et al.
2004/0007211 A1 1/2004 Kobayashi
2004/0034460 A1* 2/2004 Folkerts ..... B60W 30/188 701/54
2004/0069290 A1* 4/2004 Bucktron ..... F02D 41/0027 123/672
2004/0122584 A1 6/2004 Muto et al.
2004/0129249 A1 7/2004 Kondo
2004/0206072 A1 10/2004 Surnilla et al.
2004/0258251 A1 12/2004 Inoue et al.
2005/0016492 A1 1/2005 Matthews
2005/0056250 A1 3/2005 Stroh
2005/0098156 A1 5/2005 Ohtani
2005/0131618 A1 6/2005 Megli et al.
2005/0197761 A1 9/2005 Bidner et al.
2005/0199220 A1 9/2005 Ogiso
2005/0204726 A1 9/2005 Lewis
2005/0204727 A1* 9/2005 Lewis ..... F01L 9/04 60/285
2005/0205028 A1 9/2005 Lewis et al.
2005/0205045 A1 9/2005 Michelini et al.
2005/0205060 A1 9/2005 Michelini et al.
2005/0205063 A1 9/2005 Kolmanovsky et al.
2005/0205069 A1 9/2005 Lewis et al.
2005/0205074 A1 9/2005 Gibson et al.
2005/0235743 A1 10/2005 Stempnik et al.
2006/0107919 A1 5/2006 Nishi et al.
2006/0112918 A1 6/2006 Persson
2006/0130814 A1* 6/2006 Bolander ..... F02D 13/06 123/481
2006/0178802 A1* 8/2006 Bolander ..... B60W 10/023 701/111
2007/0012040 A1 1/2007 Nitzke et al.
2007/0042861 A1 2/2007 Takaoka et al.
2007/0051351 A1* 3/2007 Pallett ..... F02D 17/02 123/692
2007/0100534 A1 5/2007 Katsumata
2007/0101969 A1* 5/2007 Lay ..... F02M 25/00 123/304
2007/0107692 A1 5/2007 Kuo et al.
2007/0131169 A1 6/2007 Ahn
2007/0131196 A1 6/2007 Gibson et al.
2007/0135988 A1* 6/2007 Kidston ..... G07C 5/08 701/102
2007/0235005 A1 10/2007 Lewis
2008/0000149 A1 1/2008 Aradi
2008/0041327 A1 2/2008 Lewis et al.
2008/0066699 A1 3/2008 Michelini et al.
2008/0098969 A1 5/2008 Reed et al.
2008/0109151 A1* 5/2008 Jaros ..... F01L 9/02 701/115
2008/0121211 A1 5/2008 Livshiz et al.
2008/0154468 A1* 6/2008 Berger ..... B60K 6/365 701/54
2008/0254926 A1 10/2008 Schuseil et al.
2008/0262698 A1* 10/2008 Lahti ..... F02D 17/02 701/103
2008/0288146 A1 11/2008 Beechie et al.
2009/0007877 A1 1/2009 Raiford
2009/0013667 A1 1/2009 Winstead
2009/0013668 A1 1/2009 Winstead
2009/0013669 A1 1/2009 Winstead
2009/0013969 A1 1/2009 Winstead
2009/0018746 A1 1/2009 Miller et al.
2009/0030594 A1 1/2009 You et al.
2009/0042458 A1 2/2009 Kinoshita
2009/0042463 A1* 2/2009 Kinoshita ..... B63H 21/14 440/38
2009/0118914 A1* 5/2009 Schwenke ..... B60K 6/445 701/51
2009/0118968 A1 5/2009 Livshiz et al.
2009/0118975 A1* 5/2009 Murakami ..... F02D 17/02 701/103
2009/0118986 A1* 5/2009 Kita ..... F02P 5/06 701/105
2009/0177371 A1 7/2009 Reinke
2009/0204312 A1 8/2009 Moriya
2009/0241872 A1 10/2009 Wang et al.
2009/0248277 A1 10/2009 Shinagawa et al.
2009/0248278 A1 10/2009 Nakasaka
2009/0292435 A1 11/2009 Costin et al.
2010/0006065 A1 1/2010 Tripathi et al.
2010/0010724 A1 1/2010 Tripathi et al.
2010/0012072 A1* 1/2010 Leone ..... F02D 41/0087 123/192.1
2010/0030447 A1* 2/2010 Smyth ..... B60W 10/06 701/102
2010/0036571 A1* 2/2010 Han ..... G07C 5/085 701/64
2010/0042308 A1 2/2010 Kobayashi et al.
2010/0050993 A1* 3/2010 Zhao ..... F02D 17/02 123/481
2010/0059004 A1 3/2010 Gill
2010/0100299 A1* 4/2010 Tripathi ..... F02D 41/0087 701/102
2010/0107630 A1 5/2010 Hamama et al.
2010/0211299 A1 8/2010 Lewis et al.
2010/0222989 A1 9/2010 Nishimura
2010/0282202 A1* 11/2010 Luken ..... F02D 41/0002 123/184.59
2010/0318275 A1 12/2010 Borchsenius et al.
2011/0005496 A1 1/2011 Hiraya et al.
2011/0030657 A1 2/2011 Tripathi et al.
2011/0048372 A1 3/2011 Dibble et al.
2011/0088661 A1 4/2011 Sczomak et al.
2011/0094475 A1* 4/2011 Riegel ..... F02D 37/02 123/406.23
2011/0107986 A1 5/2011 Winstead
2011/0144883 A1 6/2011 Rollinger et al.
2011/0178693 A1 7/2011 Chang et al.
2011/0208405 A1 8/2011 Tripathi et al.
2011/0213540 A1 9/2011 Tripathi et al.
2011/0213541 A1 9/2011 Tripathi et al.
2011/0251773 A1 10/2011 Sahandiesfanjani et al.
2011/0264342 A1 10/2011 Baur et al.
2011/0265454 A1* 11/2011 Smith ..... F01N 3/0842 60/274
2011/0265771 A1 11/2011 Banker et al.
2011/0295483 A1 12/2011 Ma et al.
2011/0313643 A1 12/2011 Lucatello et al.
2012/0029787 A1 2/2012 Whitney et al.
2012/0055444 A1 3/2012 Tobergte et al.
2012/0103312 A1* 5/2012 Sasai ..... F02D 17/02 123/575
2012/0109495 A1 5/2012 Tripathi et al.
2012/0116647 A1* 5/2012 Pochner ..... F02D 17/02 701/102
2012/0143471 A1 6/2012 Tripathi et al.
2012/0180759 A1* 7/2012 Whitney ..... F02D 13/0219 123/406.23
2012/0221217 A1 8/2012 Sujan et al.
2012/0285161 A1 11/2012 Kerns et al.
2013/0092127 A1 4/2013 Pirjaberi et al.
2013/0092128 A1 4/2013 Pirjaberi et al.

(56) References Cited

U.S. PATENT DOCUMENTS

| | | | |
|---|---|---|---|
| 2013/0184949 | A1 | 7/2013 | Saito et al. |
| 2013/0289853 | A1 | 10/2013 | Serrano |
| 2014/0041625 | A1 | 2/2014 | Pirjaberi et al. |
| 2014/0041641 | A1 | 2/2014 | Carlson et al. |
| 2014/0053802 | A1 | 2/2014 | Rayl |
| 2014/0053803 | A1 | 2/2014 | Rayl |
| 2014/0053804 | A1 | 2/2014 | Rayl et al. |
| 2014/0053805 | A1 | 2/2014 | Brennan et al. |
| 2014/0069178 | A1 | 3/2014 | Beikmann |
| 2014/0069374 | A1 | 3/2014 | Matthews |
| 2014/0069375 | A1 | 3/2014 | Matthews et al. |
| 2014/0069376 | A1 | 3/2014 | Matthews et al. |
| 2014/0069377 | A1 | 3/2014 | Brennan et al. |
| 2014/0069378 | A1 | 3/2014 | Burleigh et al. |
| 2014/0069379 | A1 | 3/2014 | Beikmann |
| 2014/0069381 | A1 | 3/2014 | Beikmann |
| 2014/0090623 | A1 | 4/2014 | Beikmann |
| 2014/0090624 | A1 | 4/2014 | Verner |
| 2014/0102411 | A1 | 4/2014 | Brennan |
| 2014/0190448 | A1 | 7/2014 | Brennan et al. |
| 2014/0190449 | A1 | 7/2014 | Phillips |
| 2014/0194247 | A1 | 7/2014 | Burtch |
| 2014/0207359 | A1 | 7/2014 | Phillips |
| 2015/0240671 | A1 | 8/2015 | Nakamura |
| 2015/0260112 | A1 | 9/2015 | Liu et al. |
| 2015/0260117 | A1 | 9/2015 | Shost et al. |
| 2015/0354470 | A1 | 12/2015 | Li et al. |
| 2015/0361907 | A1 | 12/2015 | Hayman et al. |

FOREIGN PATENT DOCUMENTS

| | | | | |
|---|---|---|---|---|
| CN | 101220780 | A | 7/2008 | |
| CN | 101353992 | A | 1/2009 | |
| CN | 101476507 | A | 7/2009 | |
| CN | 101586504 | A | 11/2009 | |
| CN | 102454493 | A | 5/2012 | |
| EP | 1489595 | A2 | 12/2004 | |
| JP | 2010223019 | | 10/2010 | |
| JP | 2011149352 | A * | 8/2011 | ..... F02D 17/02 |

OTHER PUBLICATIONS

U.S. Appl. No. 61/952,737, filed Mar. 13, 2014, Shost et al.
U.S. Appl. No. 14/734,619, filed Jun. 9, 2015, Matthews.
International Search Report and Written Opinion dated Jun. 17, 2015 corresponding to International Application No. PCT/US2015/019496, 14 pages.
U.S. Appl. No. 14/211,389, filed Mar. 14, 2014, Liu et al.
U.S. Appl. No. 14/300,469, filed Jun. 10, 2014, Li et al.
U.S. Appl. No. 14/310,063, filed Jun. 20, 2014, Wagh et al.
U.S. Appl. No. 14/449,726, filed Aug. 1, 2014, Hayman et al.
U.S. Appl. No. 13/798,451, filed Mar. 13, 2013, Rayl.
U.S. Appl. No. 13/798,351, filed Mar. 13, 2013, Rayl.
U.S. Appl. No. 13/798,586, filed Mar. 13, 2013, Rayl et al.
U.S. Appl. No. 13/798,590, filed Mar. 13, 2013, Brennan et al.
U.S. Appl. No. 13/798,536, filed Mar. 13, 2013, Matthews et al.
U.S. Appl. No. 13/798,435, filed Mar. 13, 2013, Matthews.
U.S. Appl. No. 13/798,471, filed Mar. 13, 2013, Matthews et al.
U.S. Appl. No. 13/798,737, filed Mar. 13, 2013, Beikmann.
U.S. Appl. No. 13/798,701, filed Mar. 13, 2013, Burleigh et al.
U.S. Appl. No. 13/798,518, filed Mar. 13, 2013, Beikmann.
U.S. Appl. No. 13/799,129, filed Mar. 13, 2013, Beikmann.
U.S. Appl. No. 13/798,540, filed Mar. 13, 2013, Brennan et al.
U.S. Appl. No. 13/798,574, filed Mar. 13, 2013, Verner.
U.S. Appl. No. 13/799,181, filed Mar. 13, 2013, Beikmann.
U.S. Appl. No. 13/799,116, filed Mar. 13, 2013, Brennan.
U.S. Appl. No. 13/798,624, filed Mar. 13, 2013, Brennan et al.
U.S. Appl. No. 13/798,384, filed Mar. 13, 2013, Burtch.
U.S. Appl. No. 13/798,775, filed Mar. 13, 2013, Phillips.
U.S. Appl. No. 13/798,400, filed Mar. 13, 2013, Phillips.

* cited by examiner

CYLINDER ACTIVATION AND DEACTIVATION CONTROL SYSTEMS AND METHODS

CROSS-REFERENCE TO RELATED APPLICATIONS

This application claims the benefit of U.S. Provisional Application No. 61/693,057, filed on Aug. 24, 2012. The disclosure of the above application is incorporated herein by reference in its entirety.

This application is related to U.S patent application Ser. No. 13/798,451 filed on Mar. 13, 2013, Ser. No. 13/798,351 filed on Mar. 13, 2013, Ser. No. 13/798,590 filed on Mar. 13, 2013, Ser. No. 13/798,536 filed on Mar. 13, 2013, Ser. No. 13/798,435 filed on Mar. 13, 2013, Ser. No. 13/798,471 filed on Mar. 13, 2013, Ser. No. 13/798,737 filed on Mar. 13, 2013, Ser. No.13/798,701 filed on Mar. 13, 2013, Ser. No. 13/798,518 filed on Mar. 13, 2013, Ser. No. 13/799,129 filed on Mar. 13, 2013, Ser. No. 13/798,540 filed on Mar. 13, 2013, Ser. No. 13/798,574 filed on Mar. 13, 2013, Ser. No. 13/799,181 filed on Mar. 13, 2013, Ser. No. 13/799,116 filed on Mar. 13, 2013, Ser. No. 13/798,624 filed on Mar. 13, 2013, Ser. No. 13/798,384 filed on Mar. 13, 2013, Ser. No. 13/798,775 filed on Mar. 13, 2013, and Ser. No. 13/798,400 filed on Mar. 13, 2013. The entire disclosures of the above applications are incorporated herein by reference.

FIELD

The present disclosure relates to internal combustion engines and more specifically to cylinder activation and deactivation control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. In some types of engines, air flow into the engine may be regulated via a throttle. The throttle may adjust throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

Under some circumstances, one or more cylinders of an engine may be deactivated. Deactivation of a cylinder may include deactivating opening and closing of intake valves of the cylinder and halting fueling of the cylinder. One or more cylinders may be deactivated, for example, to decrease fuel consumption when the engine can produce a requested amount of torque while the one or more cylinders are deactivated.

SUMMARY

A ranking module determines N ranking values for N predetermined cylinder activation/deactivation sequences of an engine, respectively. N is an integer greater than or equal to two. A cylinder control module, based on the N ranking values, selects one of the N predetermined cylinder activation/deactivation sequences as a desired cylinder activation/deactivation sequence for cylinders of the engine. The cylinder control module also: activates opening of intake and exhaust valves of first ones of the cylinders that are to be activated based on the desired cylinder activation/deactivation sequence; and deactivates opening of intake and exhaust valves of second ones of the cylinders that are to be deactivated based on the desired cylinder activation/deactivation sequence. A fuel control module provides fuel to the first ones of the cylinders and disables fueling to the second ones of the cylinders.

In other features, a cylinder control method includes: determining N ranking values for N predetermined cylinder activation/deactivation sequences of an engine, respectively, wherein N is an integer greater than or equal to two; and based on the N ranking values, selecting one of the N predetermined cylinder activation/deactivation sequences as a desired cylinder activation/deactivation sequence for cylinders of the engine. The cylinder control method further includes: activating opening of intake and exhaust valves of first ones of the cylinders that are to be activated based on the desired cylinder activation/deactivation sequence; deactivating opening of intake and exhaust valves of second ones of the cylinders that are to be deactivated based on the desired cylinder activation/deactivation sequence; providing fuel to the first ones of the cylinders; and disabling fueling to the second ones of the cylinders.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Internal combustion engines combust an air and fuel mixture within cylinders to generate torque. Under some circumstances, an engine control module (ECM) may deactivate one or more cylinders of the engine. The ECM may deactivate one or more cylinders, for example, to decrease fuel consumption when the engine can produce a requested amount of torque while the one or more cylinders are deactivated. Deactivation of a cylinder may include deactivating opening and closing of intake valves of the cylinder and halting fueling of the cylinder.

The ECM of the present disclosure includes N predetermined cylinder activation/deactivation sequences, where N is an integer greater than or equal to 2. The predetermined activation/deactivation sequences each indicate whether a cylinder should be activated or deactivated, whether the following cylinder should be activated or deactivated, whether the following cylinder should be activated or deactivated, and so on.

Fuel efficiency, drive quality, and noise and vibration (N&V) are, at least in part, based on the sequence in which cylinders are activated and deactivated. The ECM determines N ranking values for the N predetermined cylinder activation/deactivation sequences, respectively. The ranking value of a predetermined cylinder activation/deactivation sequence may correspond to a predicted cost, benefit, or a combination thereof to fuel efficiency, drive quality, and N&V associated with activating and deactivating the cylinders according to that predetermined cylinder activation/deactivation sequence.

The ECM selects one of the N predetermined cylinder activation/deactivation sequences based on the ranking values to optimize fuel efficiency, drive quality, and/or N&V under the operating conditions. The ECM activates and deactivates cylinders of the engine based on the selected one of the predetermined activation/deactivation sequences.

Figure 1:
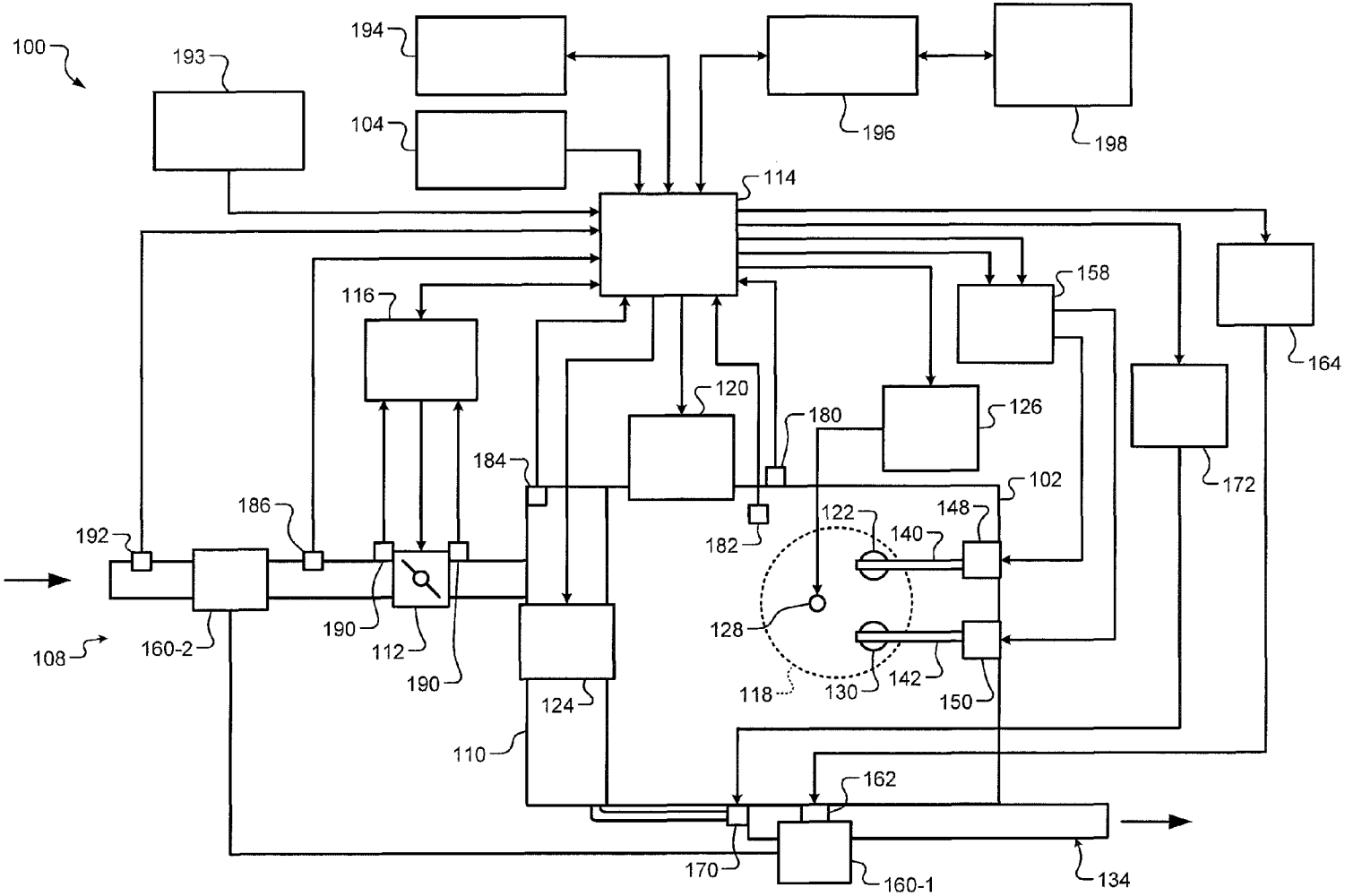
FIG. 1 is a functional block diagram of an example engine system according to the present disclosure.

Referring now to FIG. 1, a functional block diagram of an example engine system 100 is presented. The engine system 100 of a vehicle includes an engine 102 that combusts an air/fuel mixture to produce torque based on driver input from a driver input module 104. Air is drawn into the engine 102 through an intake system 108. The intake system 108 may include an intake manifold 110 and a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control airflow into the intake manifold 110.

Air from the intake manifold 110 is drawn into cylinders of the engine 102. While the engine 102 includes multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders under some circumstances, as discussed further below, which may improve fuel efficiency.

The engine 102 may operate using a four-stroke cycle. The four strokes, described below, will be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

When the cylinder 118 is activated, air from the intake manifold 110 is drawn into the cylinder 118 through an intake valve 122 during the intake stroke. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which will be referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may halt provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time at which the piston returns to a bottom most position, which will be referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). While camshaft based valve actuation is shown and has been discussed, camless valve actuators may be implemented.

The cylinder actuator module 120 may deactivate the cylinder 118 by disabling opening of the intake valve 122 and/or the exhaust valve 130. The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158. In various other implementations, the intake valve 122 and/or the exhaust valve 130 may be controlled by actuators other than camshafts, such as electromechanical actuators, electrohydraulic actuators, electromagnetic actuators, etc.

The engine system 100 may include a boost device that provides pressurized air to the intake manifold 110. For example, FIG. 1 shows a turbocharger including a turbine 160-1 that is driven by exhaust gases flowing through the exhaust system 134. The turbocharger also includes a compressor 160-2 that is driven by the turbine 160-1 and that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. Although shown separated for purposes of illustration, the turbine 160-1 and the compressor 160-2 may be mechanically linked to each other, placing intake air in close proximity to hot exhaust. The compressed air charge may absorb heat from components of the exhaust system 134.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

Crankshaft position may be measured using a crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192. The engine system 100 may also include one or more other sensors 193. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The engine 102 outputs torque to a transmission (not shown) via the crankshaft. One or more coupling devices, such as a torque converter and/or one or more clutches, regulate torque transfer between a transmission input shaft and the crankshaft. Torque is transferred between the transmission input shaft and a transmission output shaft via the gears.

Torque is transferred between the transmission output shaft and wheels of the vehicle via one or more differentials, driveshafts, etc. Wheels that receive torque output by the transmission will be referred to as drive wheels. Wheels that do not receive torque from the transmission will be referred to as undriven wheels.

The ECM 114 may communicate with a hybrid control module 196 to coordinate operation of the engine 102 and an electric motor 198. The electric motor 198 may also function as a generator, and may be used to produce electrical energy for use by vehicle electrical systems and/or for storage in a battery. While only the electric motor 198 is shown and discussed, multiple electric motors may be implemented. In various implementations, various functions of the ECM 114, the transmission control module 194, and the hybrid control module 196 may be integrated into one or more modules.

Each system that varies an engine parameter may be referred to as an engine actuator. Each engine actuator receives an actuator value. For example, the throttle actuator module 116 may be referred to as an engine actuator, and the throttle opening area may be referred to as the actuator value. In the example of FIG. 1, the throttle actuator module 116 achieves the throttle opening area by adjusting an angle of the blade of the throttle valve 112.

The spark actuator module 126 may also be referred to as an engine actuator, while the corresponding actuator value may be the amount of spark advance relative to cylinder TDC. Other engine actuators may include the cylinder actuator module 120, the fuel actuator module 124, the phaser actuator module 158, the boost actuator module 164, and the EGR actuator module 172. For these engine actuators, the actuator values may correspond to a cylinder activation/deactivation sequence, fueling rate, intake and exhaust cam phaser angles, boost pressure, and EGR valve opening area, respectively. The ECM 114 may generate the actuator values in order to cause the engine 102 to generate a desired engine output torque.

Figure 2:
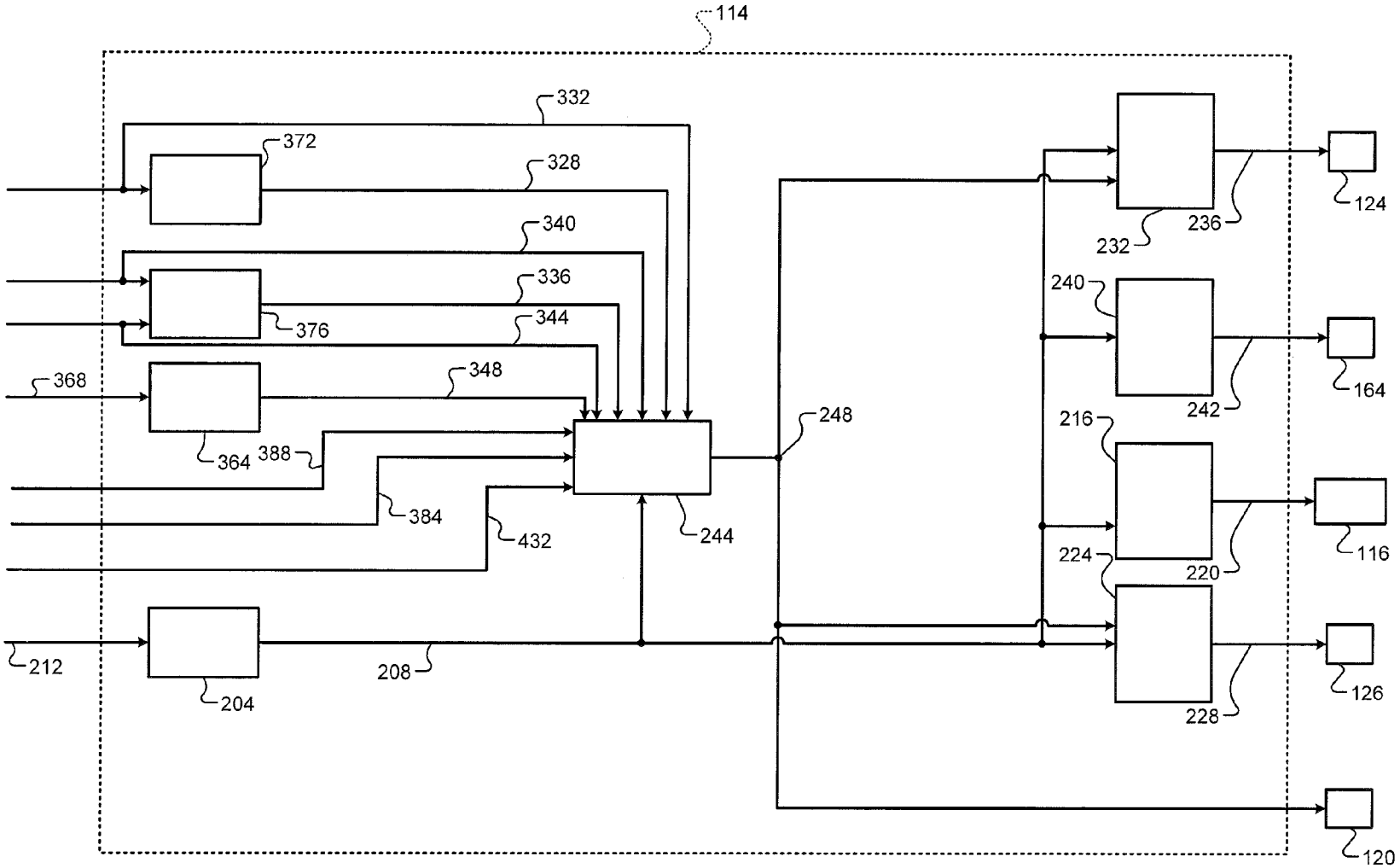
FIG. 2 is a functional block diagram of an example engine control system according to the present disclosure.

Referring now to FIG. 2, a functional block diagram of an example engine control system is presented. A torque request module 204 may determine a torque request 208 based on one or more driver inputs 212, such as an accelerator pedal position, a brake pedal position, a cruise control input, and/or one or more other suitable driver inputs. The torque request module 204 may determine the torque request 208 additionally or alternatively based on one or more other torque requests, such as torque requests generated by the ECM 114 and/or torque requests received from other modules of the vehicle, such as the transmission control module 194, the hybrid control module 196, a chassis control module, etc.

One or more engine actuators may be controlled based on the torque request 208. For example, a throttle control module 216 may determine a desired throttle opening 220 based on the torque request 208. The throttle actuator module 116 may adjust opening of the throttle valve 112 based on the desired throttle opening 220. A spark control module 224 may determine a desired spark timing 228 based on the torque request 208. The spark actuator module 126 may generate spark based on the desired spark timing 228. A fuel control module 232 may determine one or more desired fueling parameters 236 based on the torque request 208. For example, the desired fueling parameters 236 may include fuel injection amount, number of fuel injections for injecting the amount, and timing for each of the injections. The fuel actuator module 124 may inject fuel based on the desired fueling parameters 236. A boost control module 240 may determine a desired boost 242 based on the torque request 208. The boost actuator module 164 may control boost output by the boost device(s) based on the desired boost 242.

Additionally, a cylinder control module 244 (see also FIG. 3) determines a desired cylinder activation/deactivation sequence 248 based on the torque request 208. The cylinder actuator module 120 deactivates the intake and exhaust valves of the cylinders that are to be deactivated according to the desired cylinder activation/deactivation sequence 248. The cylinder actuator module 120 also allows opening and closing of the intake and exhaust valves of cylinders that are to be activated according to the desired cylinder activation/deactivation sequence 248.

Fueling is halted (zero fueling) to cylinders that are to be deactivated according to the desired cylinder activation/deactivation sequence 248, and fuel is provided the cylinders that are to be activated according to the desired cylinder activation/deactivation sequence 248. Spark is provided to the cylinders that are to be activated according to the desired cylinder activation/deactivation sequence 248. Spark may be provided or halted to cylinders that are to be deactivated according to the desired cylinder activation/deactivation sequence 248. Cylinder deactivation is different than fuel cutoff (e.g., deceleration fuel cutoff) in that the intake and exhaust valves of cylinders to which fueling is halted during fuel cutoff are still opened and closed during the fuel cutoff whereas the intake and exhaust valves remain closed when deactivated.

Figure 3:
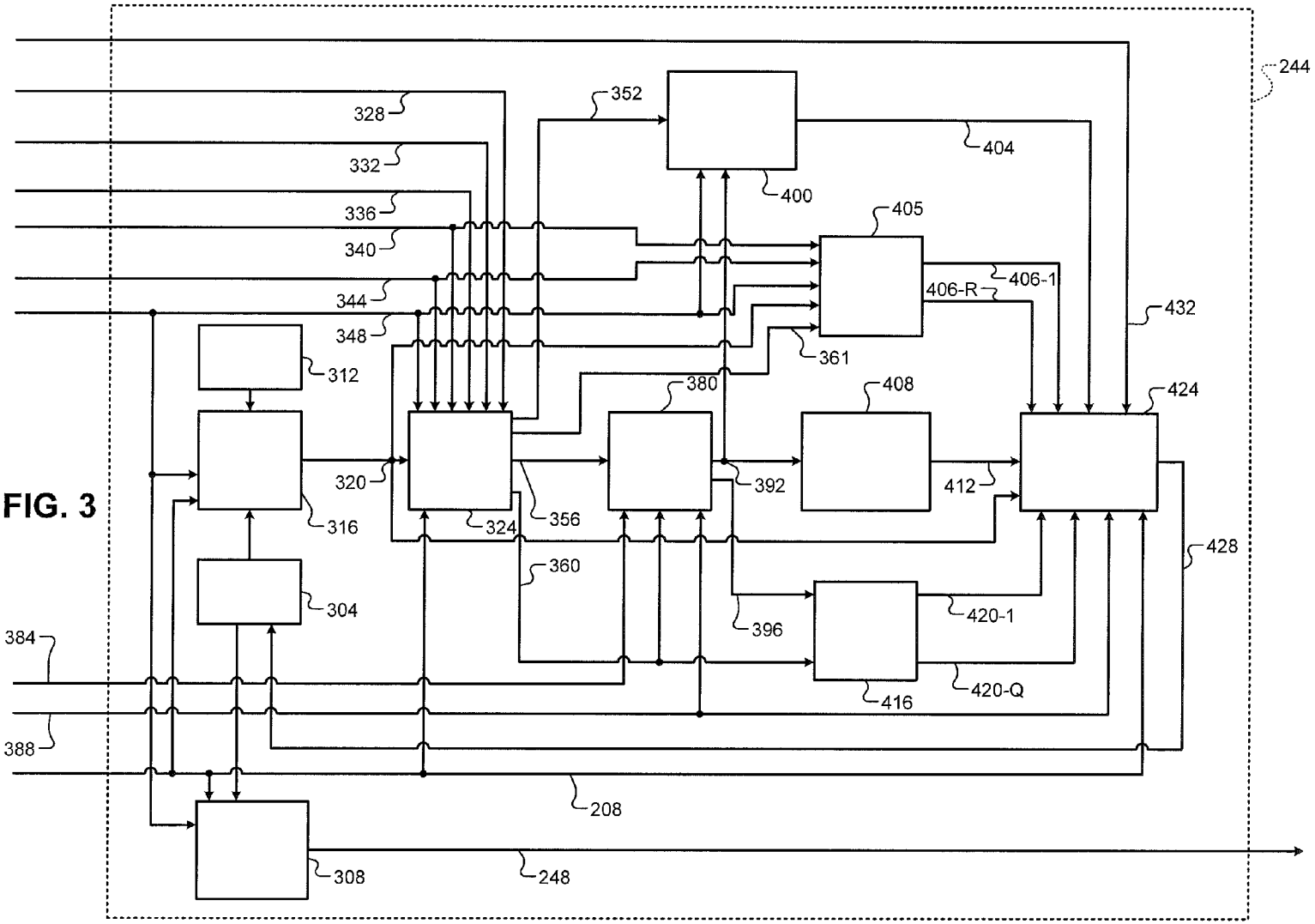
FIG. 3 is a functional block diagram of an example cylinder control module according to the present disclosure.

FIG. 3 includes a functional block diagram of an example implementation of the cylinder control module 244. Referring now to FIGS. 2 and 3, N (number of) predetermined cylinder activation/deactivation sequences are stored, such as in a sequence database 304. N is an integer greater than or equal to 2 and may be, for example, 3, 4, 5, 6, 7, 8, 9, 10, or another suitable value.

Each of the N predetermined cylinder activation/deactivation sequences includes one indicator for each of the next M events of a predetermined firing order of the cylinders. M may be an integer that is greater than the total number of cylinders of the engine 102. For example only, M may be 20, 40, 60, 80, a multiple of the total number of cylinders of the engine, or another suitable number. In various implementations, M may be less than the total number of cylinders of the engine 102. M may be calibratable and set based on, for example, the total number of cylinders of the engine 102, engine speed, and/or torque.

Each of the M indicators indicates whether the corresponding cylinder in the predetermined firing order should be activated or deactivated. For example only, the N predetermined cylinder activation/deactivation sequences may each include an array including M (number of) zeros and/or ones. A zero may indicate that the corresponding cylinder should be activated, and a one may indicate that the corresponding cylinder should be deactivated, or vice versa.

The following cylinder activation/deactivation sequences are provided as examples of predetermined cylinder activation/deactivation sequences.

(1) [0 1 0 1 0 1 . . . 0 1]
(2) [0 0 1 0 0 1 . . . 0 0 1]
(3) [0 0 0 1 0 0 0 1 . . . 0 0 0 1]
(4) [0 0 0 0 0 0 . . . 0 0]
(5) [1 1 1 1 1 1 . . . 1 1]
(6) [0 1 1 0 1 1 . . . 0 1 1]
(7) [0 0 1 1 0 0 1 1 . . . 0 0 1 1]
(8) [0 1 1 1 0 1 1 1 . . . 0 1 1 1]

Sequence (1) corresponds to a repeating pattern of one cylinder in the predetermined firing order being activated, the next cylinder in the predetermined firing order being deactivated, the next cylinder in the predetermined firing order being activated, and so on. Sequence (2) corresponds to a repeating pattern of two consecutive cylinders in the predetermined firing order being activated, the next cylinder in the predetermined firing order being deactivated, the next two consecutive cylinders in the predetermined firing order being activated, and so on. Sequence (3) corresponds to a repeating pattern of three consecutive cylinders in the predetermined firing order being activated, the next cylinder in the predetermined firing order being deactivated, the next three consecutive cylinders in the predetermined firing order being activated, and so on. Sequence (4) corresponds to all of the cylinders being activated, and sequence (5) corresponds to all of the cylinders being deactivated. Sequence (6) corresponds to a repeating pattern of one cylinder in the predetermined firing order being activated, the next two consecutive cylinders in the predetermined firing order being deactivated, the next cylinder in the predetermined firing order being activated, and so on. Sequence (7) corresponds to a repeating pattern of two consecutive cylinders in the predetermined firing order being activated, the next two consecutive cylinders in the predetermined firing order being deactivated, the next two consecutive cylinders in the predetermined firing order being activated, and so on. Sequence (8) corresponds to a repeating pattern of one cylinder in the predetermined firing order being activated, the next three consecutive cylinders in the predetermined firing order being deactivated, the next cylinder in the predetermined firing order being activated, and so on.

While the 8 example cylinder activation/deactivation sequences have been provided above, the N predetermined cylinder activation/deactivation sequences may include numerous other cylinder activation/deactivation sequences. Also, while repeating patterns have been provided as examples, one or more non-repeating cylinder activation/deactivation sequences may be included. While the N predetermined cylinder activation/deactivation sequences have been discussed as being stored in arrays, the N predetermined cylinder activation/deactivation sequences may be stored in another suitable form.

A sequence selection module 308 selects one of the N predetermined cylinder activation/deactivation sequences and sets the desired cylinder activation/deactivation sequence 248 to the selected one of the N predetermined cylinder activation/deactivation sequences. The cylinders of the engine 102 are activated or deactivated according to the desired cylinder activation/deactivation sequence 248 in the predetermined firing order. The desired cylinder activation/deactivation sequence 248 is repeated until a different one of the N predetermined cylinder activation/deactivation sequences is selected. The sequence selection module 308 determines which one of the N predetermined cylinder activation/deactivation sequences to select as described below.

A counter module 312 selectively increments a counter value (i). The counter module 312 may increment the counter value, for example, every first predetermined period, every first predetermined angle of rotation of the crankshaft, or each time that a ranking value (discussed below) is determined. For an 8-cylinder engine where one engine cycle occurs over 720 degrees of crankshaft rotation and the cylinder's TDCs are 90 degrees apart, the first predetermined angle may be less than or equal to 90 degrees divided by N (i.e., the number of predetermined cylinder activation/deactivation sequences stored). The counter module 312 may reset the counter value to zero once the counter value reaches N. While incrementing the counter value and resetting the counter value to zero have been discussed, decrementing the counter value and resetting the counter value to N may be used.

A test sequence selecting module 316 determines a subset of the N predetermined cylinder activation/deactivation sequences at a given time based on the engine speed 348 and the torque request 208. The subset of the N predetermined cylinder activation/deactivation sequences includes T out of the N predetermined cylinder activation/deactivation sequences, where T is an integer greater than zero and less than or equal to N.

The test sequence selecting module 316 selects one of the T predetermined cylinder activation/deactivation sequences at a given time based on the counter value. For example, the test sequence selecting module 316 may select a first one of the T predetermined cylinder activation/deactivation sequences when the counter value is 1, select a second one of the T predetermined cylinder activation/deactivation sequences when the counter value is 2, select a third one of the T predetermined cylinder activation/deactivation sequences when the counter value is 3, and so on. The test sequence selecting module 316 sets a test sequence 320 to the selected one of the T predetermined cylinder activation/deactivation sequences.

An engine condition prediction module 324 generates predicted engine conditions for activating and deactivating the cylinders in the predetermined firing order according to the test sequence 320 under the current operating conditions. The engine condition prediction module 324 generates the predicted engine conditions based on the test sequence 320, a mass of air per cylinder (APC) 328, a MAP 332, a mass of residual exhaust per cylinder (RPC) 336, an intake cam phaser angle 340, an exhaust cam phaser angle 344, an engine speed 348, spark timing (not shown), and air/fuel ratio (not shown).

The predicted engine conditions include a predicted fuel flow 352, a predicted engine torque 356, a predicted dynamic engine torque 360, and a predicted throttle opening 361. The predicted fuel flow 352 corresponds to a predicted flow rate (e.g., mass flow rate) of fuel to the engine 102 for activating and deactivating the cylinders according to the test sequence 320 under the current conditions 328-348 (including the air/fuel ratio. The predicted engine torque 356 corresponds to a predicted amount of torque (e.g., brake torque) at the crankshaft for activating and deactivating the cylinders according to the test sequence 320 under the current conditions 328-348 (including the air/fuel ratio and the spark timing). The predicted dynamic engine torque 360 corresponds to a predicted amount of torque (e.g., in Newton-Meters) applied to the engine block and crankshaft (equal and opposite amounts) for activating and deactivating the cylinders according to the test sequence 320 under the current conditions 328-348 (including the air/fuel ratio and the spark timing). The predicted throttle opening 361 corresponds to a predicted opening of the throttle valve 112 for activating and deactivating the cylinders according to the test sequence 320 under the current conditions 328-348.

The engine condition prediction module 324 may determine the predicted fuel flow 352 using one of a function and a mapping that relates the test sequence 320, the APC 328, the MAP 332, the RPC 336, the intake and exhaust cam phaser angles 340 and 344, the engine speed 348, and the air/fuel ratio to the predicted fuel flow 352. The engine condition prediction module 324 may determine the predicted engine torque 356 using one of a function and a mapping that relates the test sequence 320, the APC 328, the MAP 332, the RPC 336, the intake and exhaust cam phaser angles 340 and 344, the engine speed 348, the air/fuel ratio, and the spark timing to the predicted engine torque 356. The engine condition prediction module 324 may determine the predicted dynamic engine torque 360 using one of a function and a mapping that relates the test sequence 320, the APC 328, the MAP 332, the RPC 336, the intake and exhaust cam phaser angles 340 and 344, the engine speed 348, the air/fuel ratio, and the spark timing to the predicted dynamic engine torque 360. The engine condition prediction module 324 may determine the predicted throttle opening 361 using one of a function and a mapping that relates the test sequence 320, the APC 328, the MAP 332, the engine speed 348, and the torque request 208 to the predicted throttle opening 361.

An engine speed module 364 (FIG. 2) may determine the engine speed 348 based on a crankshaft position 368 measured using the crankshaft position sensor 180. An APC module 372 (FIG. 2) may determine the APC 328 based on the MAP 332, which may be measured using the MAP sensor 184. The APC module 372 may additionally or alternatively determine the APC 328 based on a MAF (not shown) measured using the MAF sensor 186. An RPC module 376 (FIG. 2) may determine the RPC 336 based on the intake and exhaust cam phaser angles 340 and 344. The RPC module 376 may additionally determine the RPC 336 based on an EGR value, such as a flow rate of EGR to the engine 102, or an opening of the EGR valve 170. The intake and exhaust cam phaser angles 340 and 344 may be measured using sensors or commanded values for the intake and exhaust cam phasers 148 and 150 may be used.

A transmission condition prediction module 380 (FIG. 3) generates predicted transmission conditions based on the predicted engine torque 356, the dynamic engine torque 360, a (current) slip value 384, and a current gear 388. The slip value 384 corresponds to a difference between the engine speed 348 and a rotational speed of the transmission input shaft. In vehicles where the transmission is an automatic transmission, the slip value 384 may be referred to as a torque converter clutch (TCC) slip. The slip value 384 may be provided by the transmission control module 194 or determined based on a difference between the rotational speed of the transmission input shaft and the engine speed 348. The current gear 388 corresponds to a current gear ratio engaged within the transmission. The current gear 388 may be provided by the transmission control module 194 or determined, for example, based on a difference between the rotational speed of the transmission input shaft and a rotational speed of the transmission output shaft.

The predicted transmission conditions may include a predicted wheel torque 392 and a predicted dynamic transmission torque 396. The predicted wheel torque 392 corresponds to a predicted amount of torque at the (e.g., driven) wheels of the vehicle for activating and deactivating the cylinders according to the test sequence 320 under the current conditions 328-348 and 384-388. In various implementations, a predicted torque on the transmission output shaft may be determined and used in place of the predicted wheel torque 392. The predicted dynamic transmission torque 396 corresponds to a predicted amount of torque (e.g., in Newton-Meters) input to the transmission input shaft for activating and deactivating the cylinders according to the test sequence 320 under the current conditions 328-348 and 384-388.

The transmission condition prediction module 380 may determine the predicted wheel torque 392 using one of a function and a mapping that relates the predicted engine torque 356, the dynamic engine torque 360, the slip value 384, and the current gear 388 to the predicted wheel torque 392. The transmission condition prediction module 380 may determine the predicted dynamic transmission torque 396 using one of a function and a mapping that relates the predicted engine torque 356, the dynamic engine torque 360, the slip value 384, the current gear 388, and the predicted dynamic engine torque 360 to the predicted dynamic transmission torque 396.

A fuel consumption prediction module 400 generates a predicted brake specific fuel consumption (BSFC) 404 for activating and deactivating the cylinders according to the test sequence 320 under the current conditions 328-348 and 384-388. The fuel consumption prediction module 400 determines the predicted BSFC 404 based on the engine speed 348, the predicted fuel flow 352, and the predicted wheel torque 392. A predicted BSFC corresponds to a predicted amount of fuel consumed by the engine 102 to produce a predicted amount of power at one or more wheels over a period of time and may be expressed, for example, in mass (e.g., grams) per unit of energy (e.g., millijoule). The fuel consumption prediction module 400 may generate the predicted BSFC 404 using one of a function and a mapping that relates the engine speed 348, the predicted fuel flow 352, and the predicted wheel torque 392 to the predicted BSFC 404.

An induction and exhaust (I/E) noise prediction module 405 generates R predicted I/E noises 406-1 through 406-R ("predicted noises 406") for activating and deactivating the cylinders according to the test sequence 320 under the current conditions 328-348. The I/E noise prediction module 405 determines the predicted noises 406 based on the test sequence 320, the predicted throttle opening 361, the engine speed 348, and the intake and exhaust cam phaser angles 340 and 344. While two of the predicted noises 406 are shown, R is an integer greater than zero. The I/E noise prediction module 405 may determine the predicted noises 406 using one or more functions or mappings that relate the test sequence 320, the predicted throttle opening 361, the engine speed 348, and the intake and exhaust cam phaser angles 340 and 344 to the predicted noises 406. Each of the predicted noises 406 corresponds to a predicted amount of (e.g., audible) noise. One or more of several methods of quantifying noise may be used to generate the predicted noises 406 including, but not limited to, their levels in a frequency spectrum, levels in a time trace, etc.

An acceleration prediction module 408 generates a predicted oscillatory longitudinal acceleration 412 for activating and deactivating the cylinders according to the test sequence 320 under the current conditions 328-348 and 384-388. The acceleration prediction module 408 determines the predicted oscillatory longitudinal acceleration 412 based on the predicted wheel torque 392 and one or more other parameters, such as vehicle mass, vehicle speed, road grade, and/or one or more other parameters. The predicted oscillatory longitudinal acceleration 412 corresponds to predicted value of low frequency acceleration attributable to torque production that may be present if the cylinders are activated and deactivated according to the test sequence 320 under the current conditions 328-348 and 384-388. The acceleration prediction module 408 may generate the predicted oscillatory longitudinal acceleration 412 using one of a function and a mapping that relates the predicted wheel torque 392 and the other parameters to the predicted oscillatory longitudinal acceleration 412.

A structural noise and vibration (N&V) prediction module 416 generates Q predicted (structural or structure borne) N&Vs 420-1 through 420-Q ("predicted N&Vs 420") for activating and deactivating the cylinders according to the test sequence 320 under the current conditions 328-348 and 384-388. The structural predicted N&V module 416 determines the predicted N&Vs 420 based on the predicted dynamic engine torque 360 and the predicted dynamic transmission torque 396. While two of the predicted N&Vs 420 are shown, Q is an integer greater than zero. The structural predicted N&V module 416 may generate the predicted N&Vs 420 using one of a function and a mapping that relates the predicted dynamic engine and transmission torques 360 and 396 to the predicted N&Vs 420.

Each of the predicted N&Vs 420 corresponds to a predicted amount of noise and vibration at a predetermined location within the vehicle, such as at a steering device of a vehicle, at a driver's side seat track, etc. The predetermined locations may be locations where vibration may be experienced by one or more passengers within a passenger cabin of the vehicle. One or more predicted N&V may be generated for each of the predetermined locations (i.e., Q may be greater than the predetermined number of locations). One or more of several methods of quantifying the N&V may be used to generate the predicted N&Vs 420 including, but not limited to, their levels in a frequency spectrum, levels in a time trace, etc.

A ranking module 424 determines a ranking value 428 for the test sequence 320 based on the torque request 208, the predicted noises 406, the current gear 388, the predicted BSFC 404, the predicted oscillatory longitudinal acceleration 412, the predicted N&Vs 420, and a vehicle speed 432. The vehicle speed 432 may be provided by the transmission control module 194 or determined, for example, based on one or more wheel speeds including driven wheel speeds, one or more undriven wheel speeds, and/or one or more other sensor input such as longitudinal acceleration, GPS-based position/speed, etc. The ranking module 424 may determine the ranking value 428, for example, using one of a function and a mapping that relates the torque request 208, the current gear 388, the predicted BSFC 404, the predicted noises 406, the predicted oscillatory longitudinal acceleration 412, the predicted N&Vs 420, and the vehicle speed 432 to the ranking value 428. The ranking module 424 may generate the ranking value 428 using individual weighting factors for each of the inputs to minimize one or more of the inputs (e.g., BSFC) while maintaining one or more other inputs within specified constraints (e.g., torque request within error band, N&V below predetermined value, etc.).

The ranking module 424 associates the ranking value 428 with the one of the N predetermined cylinder activation/deactivation sequences selected as the test sequence 320. The ranking module 424 may associate the ranking value 428 with the one of the N predetermined cylinder activation/deactivation sequences, for example, in the sequence database 304. The ranking value of a predetermined cylinder activation/deactivation sequence may correspond to a predicted cost, benefit, or a combination thereof to fuel efficiency, drive quality, and noise and vibration (N&V) that is associated with activating and deactivating the cylinders according to that predetermined cylinder activation/deactivation sequence.

While the determination of the ranking value 428 for only one of the N predetermined cylinder activation/deactivation sequences has been discussed, each of the N predetermined cylinder activation/deactivation sequences will be selected as the test sequence 320 over time. Thus, a ranking value will be determined and associated with each of the N predetermined cylinder activation/deactivation sequences.

Like the test sequence selecting module 316, the sequence selection module 308 determines the subset of the N predetermined cylinder/activation deactivation sequences (i.e., the T predetermined cylinder activation/deactivation sequences) based on the engine speed 348 and the torque request 208. The sequence selection module 308 selects one of the T predetermined cylinder activation/deactivation sequences for use as the desired cylinder activation/deactivation sequence 248 based on the ranking values associated with the T predetermined cylinder activation/deactivation sequences. For example, the sequence selection module 308 may select the one of the T predetermined cylinder activation/deactivation sequences associated with a maximum one of the ranking values or select the one of the T predetermined cylinder activation/deactivation sequences associated with a minimum one of the ranking values. As stated above, the cylinders are activated and deactivated according to the desired cylinder activation/deactivation sequence 248.

Figure 4:
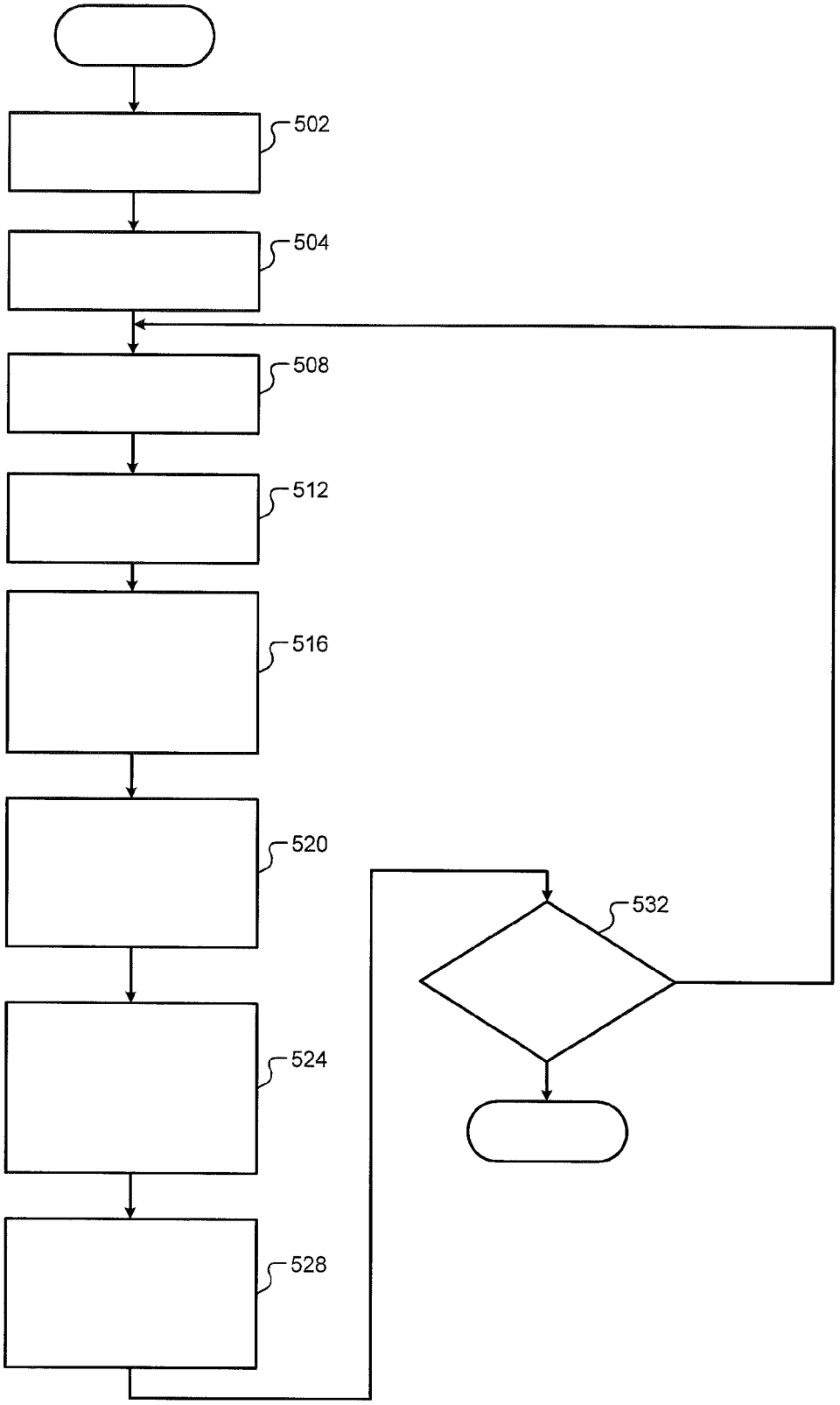
FIG. 4 is a flowchart depicting an example method of determining a ranking value for each of N predetermined cylinder activation/deactivation sequences according to the present disclosure.

Referring now to FIG. 4, a flowchart depicting an example method of determining a ranking value for each of the T predetermined cylinder activation/deactivation sequences is presented. Control may begin with 502 where the test sequence selecting module 316 determines which T of the N predetermined cylinder activation/sequences to test based on the engine speed 348 and the torque request 208. At 504, the counter module 312 resets the counter value (i). At 508, the counter module 312 increments the counter value.

At 512, the test sequence selecting module 316 selects the i-th one of the T predetermined cylinder activation/deactivation sequences as the test sequence 320. At 516, the engine condition prediction module 324 generates the predicted fuel flow 352, the predicted engine torque 356, the predicted dynamic engine torque 360, and the predicted throttle opening 361 for activating and deactivating the cylinders according to the test sequence 320 under the current conditions 328-348. The engine condition prediction module 324 determines the predicted fuel flow 352, the predicted engine torque 356, the predicted dynamic engine torque 360, and the predicted throttle opening 361 as described above.

The transmission condition prediction module 380 generates the predicted wheel torque 392 and the predicted dynamic transmission torque 396 for activating and deactivating the cylinders according to the test sequence 320 under the current conditions 328-348 and 384-388 at 520. The transmission condition prediction module 380 generates the predicted wheel torque 392 and the predicted dynamic transmission torque 396 based on the predicted engine torque 356, the predicted dynamic engine torque 360, the slip value 384, and the current gear 388, as described above.

At 524, the structural N&V prediction module 416 generates the predicted N&Vs 420 based on the predicted dynamic engine torque 360 and the predicted dynamic transmission torque 396, as described above. The fuel consumption prediction module 400 also generates the predicted BSFC 404 for activating and deactivating the cylinders according to the test sequence 320 under the current conditions 328-348 and 384-388 at 524. The I/E noise prediction module 405 also generates the predicted noises 406 for activating and deactivating the cylinders according to the test sequence 320 under the current conditions 328-348 at 524. The I/E noise prediction module 405 determines the predicted noises 406 based on the test sequence 320, the predicted throttle opening 361, the intake and exhaust cam phaser angles 340 and 344, and the engine speed 348, as discussed above. The fuel consumption prediction module 400 determines the predicted BSFC 404 based on the engine speed 348, the predicted fuel flow 352, and the predicted wheel torque 392, as discussed above. The acceleration prediction module 408 also generates the predicted oscillatory longitudinal acceleration 412 for activating and deactivating the cylinders according to the test sequence 320 under the current conditions 328-348 and 384-388 at 524. The acceleration prediction module 408 determines the predicted oscillatory longitudinal acceleration 412 based on the predicted wheel torque 392, as discussed above.

The ranking module 424 determines the ranking value 428 for the i-th one of the T predetermined cylinder activation/deactivation sequences (selected as the test sequence 320) at 528. The ranking module 424 determines the ranking value 428 based on the torque request 208, the current gear 388, the predicted BSFC 404, the predicted noises 406, the predicted oscillatory longitudinal acceleration 412, the predicted N&Vs 420, and the vehicle speed 432, as discussed above. The ranking module 424 associates the ranking value 428 with the i-th one of the T predetermined cylinder activation/deactivation sequences.

At 532, the counter module 312 determines whether the counter value (i) is equal to T (the number of the N predetermined cylinder activation/deactivation sequences associated with the torque request 208 and the engine speed 348). If true, control ends. If false, control returns to 508 to increment the counter value, select another one of the T predetermined cylinder activation/deactivation sequences, and determine the ranking value 428 for that one of the T predetermined activation/deactivation sequences. In this manner, a ranking value is determined for each of the T predetermined cylinder activation/deactivation sequences over time. While control is shown and discussed as ending after 536, FIG. 4 is illustrative of one control loop, and a control loop may be executed, for example, every predetermined amount of crankshaft rotation.

Figure 5:
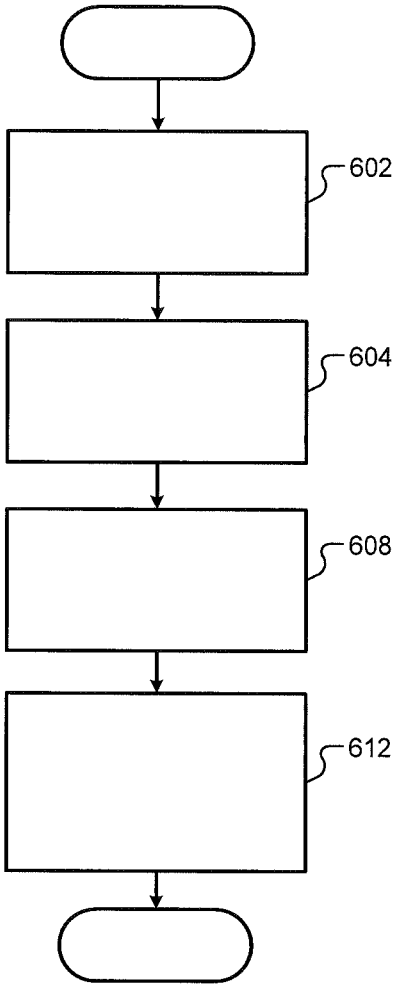
FIG. 5 is a flowchart depicting an example method of controlling cylinder activation and deactivation according to a selected one of the N predetermined cylinder activation/deactivation sequences according to the present disclosure.

Referring now to FIG. 5, a flowchart depicting an example method of activating and deactivating cylinders according to one of the N predetermined cylinder activation/deactivation sequences is presented. Control may begin with 602 where the sequence selection module 308 determines the T (of the N) predetermined cylinder activation/deactivation sequences based on the engine speed 348 and the torque request 208.

At 604, the sequence selection module 308 obtains the ranking values associated with the T predetermined cylinder activation/deactivation sequences, respectively. At 608, the sequence selection module 308 selects one of the T predetermined cylinder activation/deactivation sequences based on the ranking values. For example only, control may select one of the T predetermined cylinder activation/deactivation sequences based on the magnitudes of the ranking values, respectively. The sequence selection module 308 sets the desired cylinder activation/deactivation sequence 248 to the selected one of the T predetermined cylinder activation/deactivation sequences.

At 612, the cylinders are deactivated and activated in the predetermined firing order according to the desired cylinder activation/deactivation sequence 248. For example, if the desired cylinder activation/deactivation sequence 248 indicates that the next cylinder in the predetermined firing order should be activated, the following cylinder in the predetermined firing order should be deactivated, and the following cylinder in the predetermined firing order should be activated, then the next cylinder in the predetermined firing order is activated, the following cylinder in the predetermined firing order is deactivated, and the following cylinder in the predetermined firing order is activated.

The cylinder control module 244 deactivates opening of the intake and exhaust valves of cylinders that are to be deactivated. The cylinder control module 244 allows opening and closing of the intake and exhaust valves of cylinders that are to be activated. The fuel control module 232 provides fuel to cylinders that are to be activated and halts fueling to cylinders that are to be deactivated. The spark control module 224 provides spark to cylinders that are to be activated. The spark control module 224 may halt spark or provide spark to cylinders that are to be deactivated. While control is shown as ending after 612, FIG. 5 is illustrative of one control loop, and a control loop may be executed, for example, every predetermined amount of crankshaft rotation.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A cylinder control system of a vehicle, comprising:

a ranking module that determines N ranking values for N predetermined cylinder activation/deactivation sequences of an engine, respectively, the N predetermined cylinder activation/deactivation sequences each including M indicators for the next M cylinders, respectively, in a predetermined firing order of cylinders of the engine, and the M indicators each indicating whether to activate or deactivate the respective one of the M cylinders in the predetermined firing order, wherein N is an integer greater than or equal to two and M is an integer greater than a total number of cylinders of the engine;

at least one of:

(i) a fuel consumption prediction module that determines N predicted brake specific fuel consumptions (BSFCs) based on the N predetermined cylinder activation/deactivation sequences, respectively;

(ii) an induction and exhaust (I/E) noise prediction module that determines N sets of R predicted noise values based on the N predetermined cylinder activation/deactivation sequences, respectively;

(iii) an acceleration prediction module that determines N predicted longitudinal accelerations of the vehicle based on the N predetermined cylinder activation/deactivation sequences, respectively; and (iv) a structural noise & vibration (N&V) prediction module that determines N sets of Q predicted N&V values at B locations within a passenger cabin of the vehicle based on the N predetermined cylinder activation/deactivation sequences, respectively, wherein Q, R, and B are integers greater than zero, wherein the ranking module determines the N ranking values based on at least one of (i) the N predicted BSFCs, (ii) the N predicted longitudinal accelerations, (iii) the N sets of Q predicted N&V values, and (iv) the N sets of R predicted noise values, respectively, a cylinder control module that:

based on the N ranking values, selects one of the N predetermined cylinder activation/deactivation sequences as a desired cylinder activation/deactivation sequence for cylinders of the engine;

activates opening of intake and exhaust valves of first ones of the cylinders that are to be activated based on the desired cylinder activation/deactivation sequence; and deactivates opening of intake and exhaust valves of second ones of the cylinders that are to be deactivated based on the desired cylinder activation/deactivation sequence; and a fuel control module that provides fuel to the first ones of the cylinders and that disables fueling to the second ones of the cylinders.

2. The cylinder control system of claim 1 wherein the ranking module determines the N ranking values based on:

the N predetermined cylinder activation/deactivation sequences, respectively; and a plurality of operating conditions.

3. The cylinder control system of claim 1 wherein the ranking module determines the N ranking values further based on a vehicle speed, a gear ratio within a transmission, and a requested engine torque output.

4. The cylinder control system of claim 1 further comprising:

an engine condition prediction module that determines N predicted engine torques, N predicted dynamic engine torques, N predicted fuel flows, and N predicted throttle openings for the N predetermined cylinder activation/deactivation sequences, respectively; and a transmission condition prediction module that determines N predicted transmission input torques and N predicted torques at wheels of the vehicle for the N predetermined cylinder activation/deactivation sequences, respectively, wherein the fuel consumption prediction module determines the N predicted BSFCs based on the N predicted fuel flows and the N predicted torques at the wheels of the vehicle, respectively.

5. The cylinder control system of claim 4 wherein the acceleration prediction module determines the N predicted longitudinal accelerations based on the N predicted torques at the wheels of the vehicle, respectively.

6. The cylinder control system of claim 4 wherein the structural N&V prediction module determines the N sets of Q predicted N&V values based on the N predicted dynamic engine torques and the N predicted transmission input torques, respectively.

7. The cylinder control system of claim 4 wherein the engine condition prediction module determines the N predicted engine torques, the N predicted dynamic engine torques, the N predicted fuel flows, and the N predicted throttle openings based on:

the N predetermined cylinder activation/deactivation sequences, respectively; and at least one of a mass of air per cylinder (APC), a mass of residual exhaust gas per cylinder (RPC), a pressure within an intake manifold, an intake cam phaser angle, an exhaust cam phaser angle, and an engine speed.

8. The cylinder control system of claim 4 wherein the transmission condition prediction module determines the N predicted transmission input torques and the N predicted torques at the wheels based on:

the N predicted engine torques, respectively; and at least one of the N predicted dynamic engine torques, respectively, a gear ratio within a transmission, and a difference between an engine speed and a transmission input shaft speed.

9. The cylinder control system of claim 1 wherein the cylinder control module selects the one of the N predetermined cylinder activation/deactivation sequences associated with one of a maximum one of the N ranking values and a minimum one of the N ranking values.

10. A cylinder control method comprising:

determining N ranking values for N predetermined cylinder activation/deactivation sequences of an engine, respectively, the N predetermined cylinder activation/deactivation sequences each including M indicators for the next M cylinders, respectively, in a predetermined firing order of cylinders of the engine, and the M indicators each indicating whether to activate or deactivate the respective one of the M cylinders in the predetermined firing order, wherein N is an integer greater than or equal to two and M is an integer greater than a total number of cylinders of the engine;

at least one of:

(i) determining N predicted brake specific fuel consumptions (BSFCs) based on the N predetermined cylinder activation/deactivation sequences, respectively;

(ii) determining N sets of R predicted noise values based on the N predetermined cylinder activation/deactivation sequences, respectively;

(iii) determining N predicted longitudinal accelerations of the vehicle based on the N predetermined cylinder activation/deactivation sequences, respectively; and (iv) determining N sets of Q predicted noise & vibration (N&V) values at B locations within a passenger cabin of the vehicle based on the N predetermined cylinder activation/deactivation sequences, respectively, wherein Q, R, and B are integers greater than zero, wherein determining the N ranking values includes determining the N ranking values for the N predetermined cylinder activation/deactivation sequences of the engine, respectively, based on at least one of (i) the N predicted BSFCs, (ii) the N predicted longitudinal accelerations, (iii) the N sets of Q predicted N&V values, and (iv) the N sets of R predicted noise values, respectively, based on the N ranking values, selecting one of the N predetermined cylinder activation/deactivation sequences as a desired cylinder activation/deactivation sequence for cylinders of the engine;

activating opening of intake and exhaust valves of first ones of the cylinders that are to be activated based on the desired cylinder activation/deactivation sequence;

deactivating opening of intake and exhaust valves of second ones of the cylinders that are to be deactivated based on the desired cylinder activation/deactivation sequence;

providing fuel to the first ones of the cylinders; and disabling fueling to the second ones of the cylinders.

11. The cylinder control method of claim 10 further comprising determining the N ranking values based on:

the N predetermined cylinder activation/deactivation sequences, respectively; and a plurality of operating conditions.

12. The cylinder control method of claim 10 further comprising determining the N ranking values further based on a vehicle speed, a gear ratio within a transmission, and a requested engine torque output.

13. The cylinder control method of claim 10 further comprising:

determining N predicted engine torques, N predicted dynamic engine torques, N predicted fuel flows, and N predicted throttle openings for the N predetermined cylinder activation/deactivation sequences, respectively;

determining N predicted transmission input torques and N predicted torques at wheels of the vehicle for the N predetermined cylinder activation/deactivation sequences, respectively; and determining the N predicted BSFCs based on the N predicted fuel flows and the N predicted torques at the wheels of the vehicle, respectively.

14. The cylinder control method of claim 13 further comprising determining the N predicted longitudinal accelerations based on the N predicted torques at the wheels of the vehicle, respectively.

15. The cylinder control method of claim 13 further comprising determining the N sets of Q predicted N&V values based on the N predicted dynamic engine torques and the N predicted transmission input torques, respectively.

16. The cylinder control method of claim 13 further comprising determining the N predicted engine torques, the N predicted dynamic engine torques, the N predicted fuel flows, and the N predicted throttle openings based on:

the N predetermined cylinder activation/deactivation sequences, respectively; and at least one of a mass of air per cylinder (APC), a mass of residual exhaust gas per cylinder (RPC), a pressure within an intake manifold, an intake cam phaser angle, an exhaust cam phaser angle, and an engine speed.

17. The cylinder control method of claim 13 further comprising determining the N predicted transmission input torques and the N predicted torques at the wheels based on:

the N predicted engine torques, respectively; and at least one of the N predicted dynamic engine torques, respectively, a gear ratio within a transmission, and a difference between an engine speed and a transmission input shaft speed.

18. The cylinder control method of claim 10 further comprising selecting the one of the N predetermined cylinder activation/deactivation sequences associated with one of a maximum one of the N ranking values and a minimum one of the N ranking values.

* * * * *